US005201463A

United States Patent [19]

George

[11] Patent Number: 5,201,463

[45] Date of Patent: Apr. 13, 1993

[54] PACKAGING SYSTEM

[75] Inventor: Michael George, Jacksonville, Fla.

[73] Assignee: Kraft General Foods, Inc., Northfield, Ill.

[21] Appl. No.: 794,200

[22] Filed: Nov. 19, 1991

[51] Int. Cl.[5] ..... B65D 65/26

[52] U.S. Cl. ..... 229/203; 229/125.01; 229/162; 206/432; 206/497

[58] Field of Search ..... 229/203, 162, 120, 125.01, 229/125.09, 125.17, 125.37, 160.2, 242, 238; 206/497, 432

[56] References Cited

U.S. PATENT DOCUMENTS

| | | | |
|---|---|---|---|
| 1,656,919 | 1/1928 | Marsh | 229/235 |
| 2,330,691 | 9/1943 | Darrow | 229/203 |
| 2,442,699 | 6/1948 | Locke, Jr. | 229/242 |
| 2,785,846 | 3/1957 | Weiner | 229/162 |
| 3,136,474 | 6/1964 | Schaus et al. | 229/235 |
| 3,175,752 | 3/1965 | Stabenow | 229/203 |
| 3,263,807 | 8/1966 | Fingerhut | 229/238 |
| 3,276,665 | 10/1966 | Rasmussen | 229/235 |
| 3,276,667 | 10/1966 | Johnson et al. | 229/235 |
| 3,456,780 | 7/1969 | Forman | 206/497 |
| 3,523,637 | 8/1970 | Stec | 229/203 |
| 3,873,018 | 3/1975 | Donnay | 206/497 |
| 4,017,016 | 4/1977 | Ivy | 229/23 BT |
| 4,077,516 | 3/1978 | Duerr | 206/432 |
| 4,133,430 | 1/1979 | Cravens | 206/497 |
| 4,512,511 | 4/1985 | Zimmermann | 229/125.19 |
| 4,727,706 | 3/1988 | Beer | 206/524.8 |
| 4,971,242 | 11/1990 | LaNicca | 229/23 R |
| 5,067,612 | 11/1991 | Tsuchiya et al. | 206/497 |

FOREIGN PATENT DOCUMENTS

| | | | |
|---|---|---|---|
| 2428585 | 2/1980 | France | 206/497 |

*Primary Examiner*—Allan N. Shoap
*Assistant Examiner*—Christopher J. McDonald
*Attorney, Agent, or Firm*—Thomas A. Marcoux; Linn I. Grim; Thomas R. Savoie

[57] ABSTRACT

A packaging system is provided for a plurality of packages which are vulnerable to damage when cut into by a sharp instrument. The packaging system includes a rectangular container enclosing all of the packages and being formed of a rectangular lid and a rectangular tray configuration, preferably in a mating and nonoverlapping configuration, to form the container. A shrink wrap material is applied about the container and shrunk into engagement therewith so as to encircle the container in three dimensions and thus hold the lid and tray in the mating configuration. The shrink wrap material is suitably weakened to allow a manual tearing of the shrink wrap material to release the lid and hence open the container. The shrink wrap material is weakened by a longitudinal slot located adjacent the lid and extending from one side of the lid to an opposite side and two paired series of weakenings in the shrink wrap material. Each respective paired series extends laterally away from the slot and each paired series has one series of weakenings separated from the other series and provided along the lid adjacent a respective side. Preferably, the packages are rectangular and arranged in two rows in the container, and selected sides include apertures therein which together provide a view of each one of the packages.

10 Claims, 1 Drawing Sheet

PACKAGING SYSTEM

FIELD OF THE INVENTION

The present invention relates generally to a packaging system which protects packages in a container susceptible to damage by being cut with a razor or the like in opening of the container, and more particularly to a packaging system including a wrapping means surrounding a container which is weakened to allow a manual opening without cutting of the packaging system.

BACKGROUND OF THE INVENTION

Many food and other packages are susceptible to damage by the slightest opening in their package. Typically, the damage which results is that the product contained therein becomes spoiled or stale or otherwise unsuitable for sale or use. Such packages, including foil wrapped brick coffee, are typically shipped in cardboard boxes which are opened by means of a razor moved around the peripheral sides of the cardboard box. If the razor extends too far through the cardboard during such cutting and pierces a package therein, the product is usually damaged or ruined. This is a frequent problem, and results in significant losses in returned or damaged products.

In order to help avoid this problem, foil wrapped brick coffee has been contained in a rectangular box formed of a lid (top) and a tray (bottom) much like that depicted in FIG. 2. A shrink wrap was then applied around the box which was easily tearable from a lateral slot. However, because shrink wrap material tears or stretches in no particular direction, it was found that those responsible for opening such packaging systems still found it easiest or convenient to use a razor to cut the shrink wrap and open the container so that the packages contained therein were still liable to be damaged through use of the razor.

Various shrink wrap packages have also been disclosed in the prior art which are designed for easy opening. For example, U.S. Pat. Nos. 3,273,302 (Walter) and U.S. Pat. No. 3,403,840 both disclose a rectangular package completely surrounded by a shrink wrap with an easy opening means. The easy opening means is a lift tab provided on an end adjacent a pair of score lines extending along the lid of the package. Other packages having lift tabs which facilitate further tearing of a shrink wrap are disclosed in U.S. Pat. Nos. 3,344,975 (Stoker, Jr.), U.S. Pat. No. 3,442,436 (Kirby, Jr.), U.S. Pat. No. 3,175,752 (Stabenow), and U.S. Pat. No. 4.077,516 (Duerr).

SUMMARY OF THE INVENTION

In accordance with the present invention, a packaging system is provided for a plurality of packages which are vulnerable to damage when cut into by a sharp instrument. The packaging system overcomes the need for use of a sharp instrument for opening, and thus avoids the problems of the prior art. The packaging system includes a container for holding the plurality of packages. The container enclosing all of the packages is formed of two container portions which come together in a container configuration, preferably in a mating and non-overlapping container configuration, to form the container which is generally of a parallelpiped shape. A wrapping means encircles the container and holds the container portions in the container configuration. A weakening means is then provided for weakening the wrapping means to allow a manual removal or breaking of the wrapping means from about one of the container portions.

In a preferred embodiment, the wrapping means is a shrink wrap material applied about the container and shrunk into engagement therewith. With this construction, the weakening means includes a slot in the shrink wrap material. In addition, the weakening means further includes two paired series of weakenings in the shrink wrap material, each respective paired series extending away from a respective side of the slot and each paired series having one series of weakenings separated from the other series.

In the preferred embodiment, the container is a rectangular box, and the container portions are a rectangular lid and a rectangular tray, both of which have four peripheral sides of equal height and which come together in a mating and nonoverlapping configuration. With this configuration, the slot is located adjacent this lid, and the series of weakenings are provided along the lid and adjacent a respective side.

Preferably, the packages are rectangular and arranged in two rows in the container. In addition, the shrink wrap material is transparent and applied about the container in three dimensions. Selected sides, such as the sides of the tray which are preferably taller than the sides of the lid, then include apertures therein which together provide a view of each one of the packages.

The container is made of cardboard and the packages are foil wrapped brick coffee in the most preferred embodiment of the invention.

It is an advantage of the present invention that the container is most easily opened manually without the use of a sharp instrument so that damage to the packages contained therein is avoided.

It is also an advantage of the present invention that each of the packages exhibits a visual change when damage occurs and that each package is viewable in the container. Thus, any damage to the packages can be seen while the packages are still in the container.

It is a further advantage of the present invention that a packaging system is provided which is simple and easy to form and to open.

Other features and advantages of the present invention are stated in or apparent from detailed descriptions of presently preferred embodiments of the invention found hereinbelow.

BRIEF DESCRIPTION OF THE DRAWINGS

Preferred embodiments of the invention will now be described with respect to the drawings, wherein.

DETAILED DESCRIPTION OF THE PREFERRED EMBODIMENTS

Figure 1:
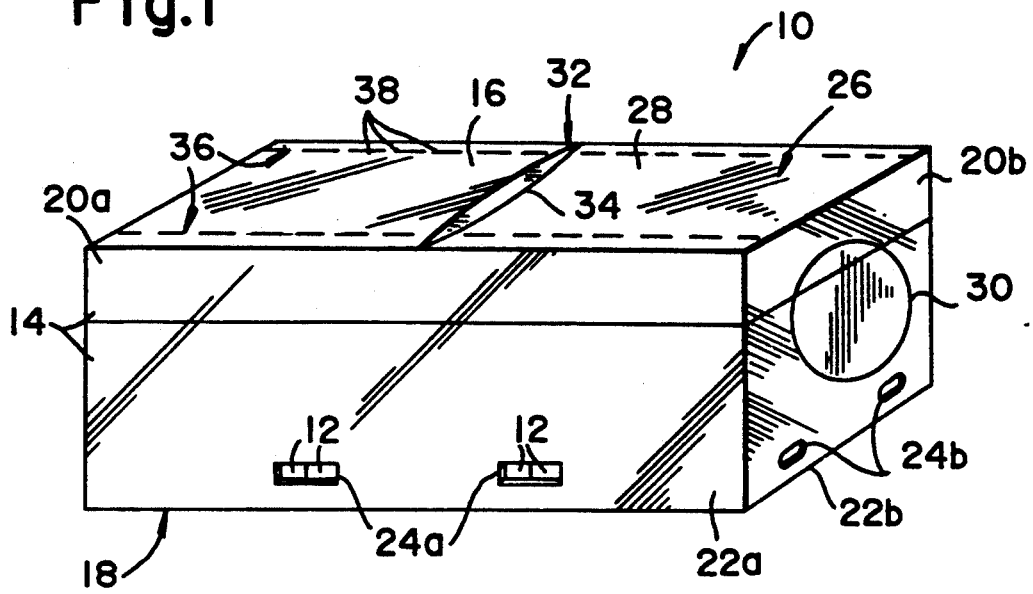
FIG. 1 is a perspective view of a packaging system according to the present invention.
Figure 2:
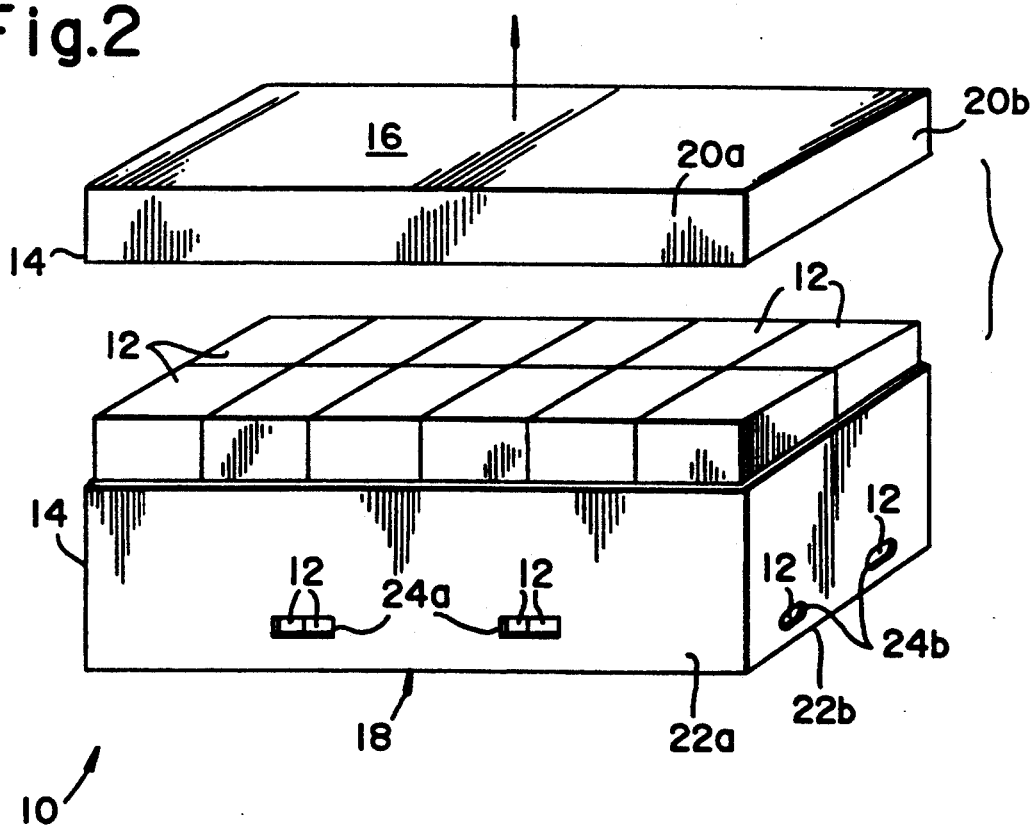
FIG. 2 is a perspective view of the packaging system depicted in FIG. 1 with the outer wrapping removed and the lid lifted above the remainder.

With reference now to the drawings where like numerals represent like elements throughout the two views, a packaging system 10 is depicted in FIGS. 1 and 2. Packaging system 10 is used to contain rectangular packages 12 for shipping and handling. Packages 12 need special care, as packages 12 are "vulnerable", that is subject to damage when cut into by a sharp instrument or the like. In this embodiment, packages 12 contain a food, and in particular are foil wrapped bricks of coffee. Such bricks of coffee are vacuum packed and stay fresh in a hard brick form so long as no air is allowed inside of the foil wrapping. However, if even a pinhole is made in the foil wrapping, the brick form of the coffee is destroyed. Instead of the brick form, the coffee then becomes merely a pile of loose grounds, and the air admitted to the coffee quickly causes the coffee to become stale.

It will thus be appreciated that it is extremely important that the foil wrapping of package 12 not be broken or cut into at any time before the consumer is ready to use the coffee. In order to avoid such damage, packaging system 10 completely protects the packages during handling and shipping In addition, packaging system 10 also includes a unique opening mechanism. Thus, when container 14 is opened, usually by unskilled personnel in the process of placing packages 12 on shelves to be sold, sharp instruments (typically a razor knife or the like) are not used or needed, and in fact are more trouble to use than the opening mechanism provided.

Packaging system 10 includes a generally parallelpiped container 14 in the form of a cardboard box. Container 14 includes a first container portion in the form of a rectangular lid 16 and a second container portion in the form of a rectangular tray 18. As shown, both lid 16 and tray 18 have respective peripheral sides 20*a*, 20*b* and 22*a*, 22*b* which are all of the same respective height (though the height of the respective sides 22*a*, 22*b* of tray 18 is greater than the height of the respective sides 20*a*, 20*b* of lid 16). It should be appreciated that in this preferred embodiment respective sides 20*a*, 20*b* and 22*a*, 22*b* come together in a container configuration which in this preferred embodiment is a mating configuration with the edges of the respective sides abutting one another but not overlapping (although this is not required). Thus, lid 16 and tray 18 are never physically attached to one another, so that lid 16 and tray 18 are easily separated from one another as shown in FIG. 2 where lid 16 is being removed from tray 18.

Packages 12 are arranged in container 14 in two rows. Provided in side 22*a* of tray 18 (and in the opposite side not shown) are apertures 24*a*, and provided in side 22*b* (and in the opposite side not shown) are apertures 24*b*. By use of apertures 24, a small portion of each one of the packages 12 is visible therethrough (note that portions of two separate packages are visible through apertures 24*a*). Thus, should any damage occur to any package 12 which allows air to enter, the appearance of that package will be altered, and in particular the vacuum conformance of the foil wrap will be lost so that the characteristic shape will be altered. Such an alteration will then be viewable through the associated aperture 24 to alert the handler or an inspector.

In order to hold lid 16 and tray 18 together in abutting configuration as container 14 and maintain packages 12 therein, a wrapping means 26 is applied about container 14. Preferably, wrapping means 26 is a shrink wrap material 28 which is shrunk into a three dimensional engagement with container 14 leaving an opening 30 at each end (only one of which is shown). With shrink wrap material 28 thus encircling container 14, container 14 is suitably held together for shipping and handling. It should also be appreciated that shrink wrap material 28 is transparent so that packages 12 are viewable through apertures 24 to check for any damage thereto.

While shrink wrap material 28 could be cut from container 14 with a razor knife or the like, this would almost certainly result in occasional damage to packages 12. Therefore, shrink wrap material 28 is provided with a weakening means 32 for weakening shrink wrap material 28. Weakening means 32 thus allows an easy manual removal of shrink wrap material 28 from container 14, or at least from about one of lid 16 or tray 18 or from between them so that lid 16 can be removed from above packages 12. In this preferred embodiment, weakening means 32 includes a slot 34 which extends laterally along lid 16 from one side 20*a* to the other. In addition, weakening means 32 includes two paired lines or series 36 of weakenings 38 in shrink wrap material 28. As shown, each respective paired series 36 extends away from a respective side of slot 34, and each paired series 36 has one series 36 of weakenings 38 separated from the other series 36 and adjacent an associated side 20*a* of lid 16. Conveniently, weakenings 38 are simply cuts or scores made at spaced intervals along shrink wrap material 28 as shown.

It will be appreciated that shrink wrap material 28 in general tends to pull or stretch in no particular direction. Therefore, the presence of weakenings 38 are required in order to provide for the desired directional tearing of shrink wrap material 28. It should also be appreciated that while shrink wrap material 28 is somewhat weakened by weakenings 38, this is only in a factor when a sustained force in the specific direction or orientation of weakenings 38 is exerted. Thus, shrink wrap material 28 still easily withstands abusive handling and palletizing distribution and handling to be expected in food stores and the like.

In use, packaging system 10 is used to contain packages 12 for shipping and handling. Any time during this process, packages 12 can be viewed to determine if any damage has occurred to packages 12. Then, when it is desired to unpack packages 12 from container 14, the unpacker simply inserts the fingers of each hand through slot 34 and underneath of shrink wrap material 28. By pulling up and toward respective sides 20*b*, shrink wrap material 28 is torn by this action easily along each series 36 of weakenings 38. This results in the loosening of shrink wrap material 28 from around container 14, so that lid 16 is easily lifted away from tray 18 as shown in FIG. 2. It is then a simple matter to lift packages 12 from tray 18.

It should be appreciated that it is considered easier to tear shrink wrap material 28 manually as discussed above than to make a series of peripheral cuts in shrink wrap material 28 with a razor knife. Thus, the unpacker will be less tempted to use a razor knife even if one is available (which it usually is).

While the present invention has been described with respect to an exemplary embodiment thereof, other embodiments are possible. For example, instead of slot 34, a pair of tear tabs could be provided. In addition, instead of scores as weakenings 38, another type of tear line could be used. Thus, it will be understood by those of ordinary skill in the art that variations and modifications can be effected within the scope and spirit of the invention.

What is claimed is:

1. A packaging system comprising:

a plurality of packages which are vulnerable to damage when cut into by a sharp instrument;

a generally parallelpiped container for holding said plurality of packages, said container enclosing all of said packages and being formed of two container portions having generally rectangular bases, each container portion base having first opposed edges and second opposed edges extending generally perpendicular to the first opposed edges, said container portions also having side walls extending from the bases towards the other container portion to form the said generally parallelpiped container which has first opposed ends formed between the said first opposed edges and second opposed ends formed between the said second opposed edges, a wrapping means which encircles said container for holding said container portions against the plurality of packages contained therein to form said generally parallelpiped container configuration, said wrapping means being a shrink wrap material applied about said container and shrunk into engagement therewith; and removal means for facilitating easy manual removal of the shrink wrap material from the container, said removal means including a slot formed in the shrink wrap material and extending substantially across the exterior of one of said container portion bases in a direction from one of said second opposed ends to the other of said second opposed ends, and weakening means comprising a pair of weakened lines formed in the shrink wrap material and extending from the slot, generally perpendicular thereto in both directions from the slot toward the first opposed ends of the container, said weakening means being positioned close enough to an adjacent one of said second opposed ends that when the weakening means is manually broken, the shrink wrap material is easily removed sufficiently from the container to permit direct essentially unobstructed removal of one of said container portions off of the packages.

2. A packaging system according to claim 1, wherein each weakened line is located adjacent one of said second opposed ends.

3. A packaging system according to claim 1, wherein one of the container portions is a lid and the other is a tray, the lid having shorter side walls than the tray, and the slot extending across the lid.

4. A packaging system according to claim 3, wherein the packages are rectangular and are arranged in two rows in the container.

5. A packaging system according to claim 4, wherein the wrapping means is transparent and wherein selected ones of said side walls include apertures therein which together provide a view of each one of said packages.

6. A packaging system according to claim 5, wherein said apertures are provided in the side walls of the tray.

7. A packaging system according to claim 1, wherein the container is made of cardboard.

8. A packaging system according to claim 7, wherein the packages are vacuum packed foil wrapped brick coffee.

9. A packaging system according to claim 1, wherein said shrink wrap material is opened at the first opposed ends of the container.

10. A packaging system according to claim 1, wherein the weakened lines comprise a series of cuts extending from the slot towards the first opposed ends.

* * * * *